US005953231A

United States Patent [19]

Miller et al.

[11] Patent Number: 5,953,231

[45] Date of Patent: Sep. 14, 1999

[54] AUTOMATED QUALITY CONTROL FOR STITCHING OF TEXTILE ARTICLES

[75] Inventors: Jeffrey L. Miller, Hermosa Beach; Alan Markus, Lake Forest, both of Calif.

[73] Assignee: McDonnell Douglas Corporation, St. Louis, Mo.

[21] Appl. No.: 08/996,468

[22] Filed: Dec. 22, 1997

[51] Int. Cl.[6] ..... G06F 19/00; G06G 7/66

[52] U.S. Cl. ..... 364/470.14; 364/470.09

[58] Field of Search ..... 364/470.14, 470.09; 112/121.12, 262.1, 254, 262.3, 278, 103; 318/568

[56] References Cited

U.S. PATENT DOCUMENTS

| | | | |
|---|---|---|---|
| 3,312,184 | 4/1967 | Cash | 112/118 |
| 3,515,080 | 6/1970 | Ramsey | 112/121.14 |
| 4,067,276 | 1/1978 | Mohilo et al. | 112/220 |
| 4,092,938 | 6/1978 | Coughenour | 112/158 |
| 4,104,976 | 8/1978 | Landau, Jr. | 112/121.11 |
| 4,221,176 | 9/1980 | Besore et al. | 112/121.12 |
| 4,285,293 | 8/1981 | Martling | 112/281 |
| 4,289,087 | 9/1981 | Takenoya et al. | 112/254 |
| 4,331,091 | 5/1982 | Parker et al. | 112/262.1 |
| 4,429,364 | 1/1984 | Maruyama et al. | 364/400 |
| 4,446,520 | 5/1984 | Shigeta et al. | 364/400 |
| 4,481,507 | 11/1984 | Takuguchi et al. | 340/679 |
| 4,503,788 | 3/1985 | Giannuzzi et al. | 112/121.12 |
| 4,506,611 | 3/1985 | Parker et al. | 112/79 |
| 4,776,291 | 10/1988 | Tajima et al. | 112/98 |
| 4,786,343 | 11/1988 | Hertzbert | 156/93 |
| 4,798,152 | 1/1989 | Simons et al. | 112/262.1 |
| 4,815,404 | 3/1989 | Ellermann et al. | 112/121.11 |
| 4,843,986 | 7/1989 | Kozuka et al. | 112/163 |
| 4,873,931 | 10/1989 | Takagi et al. | 112/121.11 |
| 4,876,973 | 10/1989 | Marrache et al. | 112/121.16 |
| 4,899,287 | 2/1990 | Hulshoff et al. | 364/470 |
| 4,917,756 | 4/1990 | Cahuzac et al. | 156/429 |
| 4,992,317 | 2/1991 | Chess et al. | 428/102 |
| 5,095,835 | 3/1992 | Jernigan et al. | 112/262.3 |
| 5,218,916 | 6/1993 | Kurono et al. | 112/121.12 |
| 5,239,475 | 8/1993 | Shigeta et al. | 364/470 |
| 5,287,820 | 2/1994 | Stutznacker | 112/117 |
| 5,299,519 | 4/1994 | Hirabayashi | 112/456 |
| 5,341,755 | 8/1994 | Kawasaki | 112/163 |
| 5,379,226 | 1/1995 | Shigeta | 364/470 |
| 5,383,417 | 1/1995 | Norrid | 112/278 |
| 5,392,724 | 2/1995 | Kurono et al. | 112/121.12 |
| 5,473,535 | 12/1995 | Shigeta et al. | 364/191 |
| 5,474,001 | 12/1995 | Tajima et al. | 112/102.5 |
| 5,510,994 | 4/1996 | Tsonis et al. | 364/470 |
| 5,515,798 | 5/1996 | Cahuzac | 112/470.12 |
| 5,537,945 | 7/1996 | Sugihara et al. | 112/470.06 |
| 5,543,005 | 8/1996 | Monget et al. | 156/93 |

*Primary Examiner*—Paul P. Gordon
*Assistant Examiner*—Victoria Robinson
*Attorney, Agent, or Firm*—Westerlund & Powell, P.C.; Robert A. Westerlund; Ramon R. Hoch

[57] ABSTRACT

Quality control for stitching of a textile article is performed by measuring thread tension in the stitches as the stitches are being made, determining locations of the stitches, and generating a map including the locations and stitching data derived from the measured thread tensions. The stitching data can be analyzed, off-line or in real time, to identify defective stitches. Defective stitches can then be repaired. Real time analysis of the thread tensions allows problems such as broken needle threads to be corrected immediately.

22 Claims, 3 Drawing Sheets

AUTOMATED QUALITY CONTROL FOR STITCHING OF TEXTILE ARTICLES

This invention was made under contract no. NAS1-18862 awarded by NASA. The Government has certain rights in this invention.

BACKGROUND OF THE INVENTION

This invention relates to textile manufacturing. More specifically, this invention relates to quality control for stitching of textile articles.

Large aircraft structures such as wing covers are now being fabricated from textile composites. The textile composites are attractive because of their potential for lowering the cost of fabricating the large aircraft structures. Cutting pieces of fabric and stitching the fabric pieces together have the potential of being less expensive then cutting sheets of aluminum, drilling holes in the aluminum sheets, removing excess metal and assembling metal fasteners.

The wing cover can be made from a carbon-fiber textile composite. Sheets of knitted carbon-fiber fabric are cut out into pieces having specified sizes and shapes. Fabric pieces having the size and shape of a wing are laid out first. Several of these pieces are stacked to form the wing cover. Additional pieces are stacked to provide added strength in high stress areas. After the fabric pieces are arranged in their proper positions, the pieces are stitched together to form a wing preform. Secondary details such as spar caps, stringers and intercostals are then stitched onto the wing preform. Such a wing preform might have a thickness varying between 0.05 inches and 1.5 inches. The wing preform is quite large, and its surface is very complex, usually a compound contoured three-dimensional surface.

The wing preform is transferred to an outer mold line tool that has the shape of an aircraft wing. Prior to the transfer, a surface of the outer mold line tool is covered with a congealed epoxy-resin. The tool and the stitched preform are placed in an autoclave. Under high pressure and temperature, the resin is infused into the stitched preform and cured. Resulting is a cured wing cover that is ready for assembly into a final wing structure.

For textile composite technology to be successful, two barriers must be overcome: cost and damage tolerance. Damage tolerance appears to have been hurdled. Closely-spaced stitches on the wing preform provide sufficient damage tolerance because the stitches provide a third continuous column of material.

Cost continues to be the problem. Although the textile composites are less expensive than aluminum, and textile manufacturing techniques are old and proven, the machines for stitching are slow and unreliable. This problem is especially true for wing preforms because an exceedingly large number of stitches must be made, and they must be made in a contoured, compound three-dimensional surface.

Many hours are spent on quality control. Visual inspections are performed to ensure that the stitches have proper spacing and tension. Loose threads and broken stitches are identified. Irregular-sized holes surrounding the threads are also identified. Too small a hole might suggest an overly tight stitch; too large a hole might suggest a loose stitch.

Moreover, the visual inspection is subjective; its accuracy is dependant upon the attentiveness of the person performing the inspection. Still, for a small structure, visual inspection might be feasible. A few defective stitches could be identified and repaired.

However, quality control by visual inspection is extremely slow, costly and error-laden for a wing preform that might have eight to ten stitches per inch, in rows that might be spaced 0.1 inches to 0.5 inches apart, over a surface that might be longer than forty feet and wider than eight feet. Manually finding defective stitches, keeping track of the locations of the bad stitches, and removing and repairing the bad stitches cannot be done quickly, accurately and cost-effectively.

Based on the foregoing, it can be appreciated that there presently exists a need for quality control that can be performed quickly, accurately and cost-effectively. As will become apparent hereinafter, the present invention fulfills this need.

SUMMARY OF THE INVENTION

The invention can be regarded as an automated stitching system comprising a stitching machine including a stitching head operable to make a plurality of stitches, and means for generating a signal indicative of a parameter of the stitches while the stitching head is making the stitches; and a control station including a processor and computer memory. The memory is encoded with data for instructing the processor to determine locations of the stitching head; derive stitching data from the signal; and generate a map of the locations and the stitching data, whereby the stitching data is traceable to the stitches.

The invention can also be regarded as an apparatus for performing quality control on a plurality of stitches made by a stitching machine. The apparatus comprises means for measuring thread tension of the stitches while the stitches are being made; a processor; and computer memory encoded with data for instructing the processor to determine locations of the stitching head; derive stitching data from the signal; and generate a map of the locations and the stitching data. The map is stored in the computer memory.

The invention can also be regarded as a method of performing quality control on a plurality of stitches. The method comprises the steps of generating a signal proportional to a parameter of the stitches while the stitches are being made; deriving stitching data from the signal; determining locations of the stitches; and generating a map including the locations of the stitches and the stitching data.

The invention can also be regarded as an article of manufacture for a stitching system. The article comprises computer memory; and data, encoded in the memory, for instructing a processor to determine locations of a stitching head; derive stitching data from a signal that is proportional to thread tension along a thread path in the stitching head; and generate a map of the locations and the stitching data.

BRIEF DESCRIPTION OF THE DRAWINGS

The above and other objects, features and advantages of the present invention will become apparent from the following detailed description taken in conjunction with the accompanying drawings, in which.

DETAILED DESCRIPTION OF THE PREFERRED EMBODIMENTS

While the present invention is described herein with reference to the illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
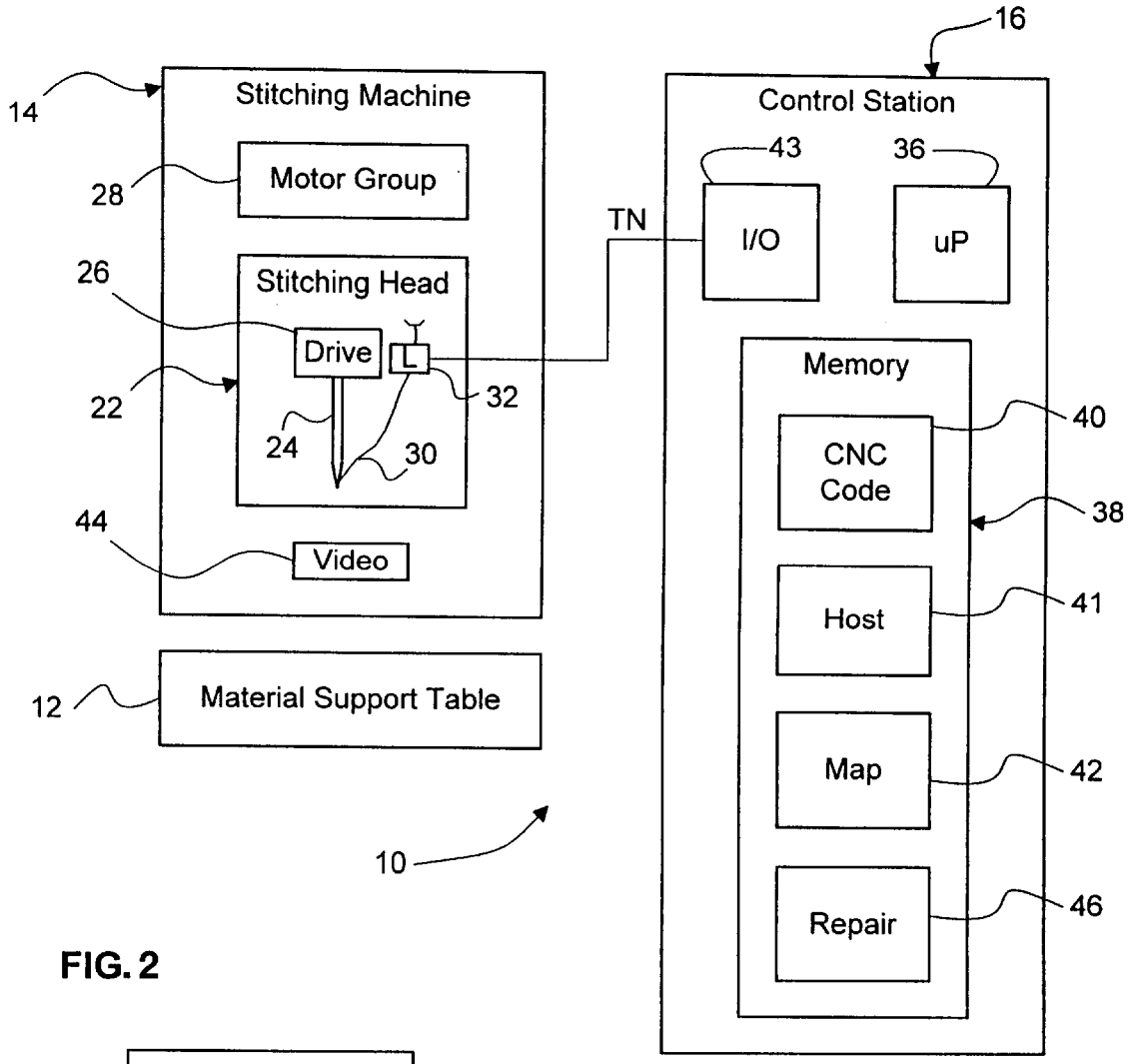
FIG. 1 is a block diagram of a stitching system according to the present invention.

FIG. 1 shows an automated stitching system 10 including a material support table 12, a stitching machine 14 and a control station 16. The material support table 12 provides a surface for supporting a preform. The surface of the material support table 12 can be tailored to the desired shape of the preform. For example, the material support table 12 can provide a flat two-dimensional surface, a contoured three-dimensional surface, or a compound, contoured three-dimensional surface.

Figure 2:
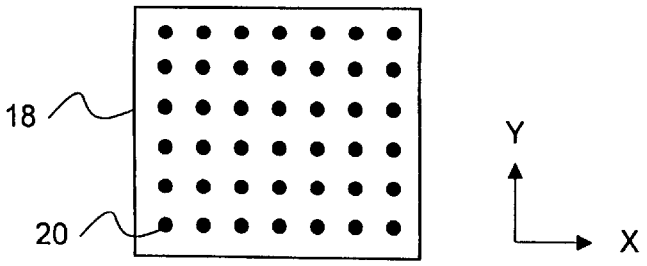
FIG. 2 is a schematic diagram of an exemplary preform.

FIG. 2 shows an exemplary preform 18 having a simple two-dimensional surface. Stitching points on the preform 18 are denoted by dots 20. Such a preform 18 having a simple surface marked with dots 20 is shown merely to simplify the explanation of the invention. FIG. 2 also shows the x and y directions relative to the surface of the preform 18.

Returning to FIG. 1, the stitching machine 14 is a computer numerically controlled ("CNC") machine. The stitching machine 14 includes a stitching head 22 operable to make a plurality of stitches in the preform 18. The stitching head 22 includes a stitching needle 24 and a needle-drive mechanism 26 for reciprocating the needle 24. The stitching machine 14 also includes a motor group 28 for positioning the stitching head 22 over the preform 18. The motor group 28 includes a first servo-controlled motor for positioning the needle with respect to an x-axis and a second servo-controlled motor for positioning the needle with respect to a y-axis. The motor group 28 could also include a third servo-controlled motor for positioning the needle with respect to a z-axis and a fourth servo-controlled motor for positioning the needle with respect to a rotational c-axis. The third and fourth servo-controlled motors would allow the stitching machine 14 to stitch a preform having a compound, contoured three-dimensional surface. Of course, the motor group 28 could include additional servo-controlled motors if additional degrees of freedom are desired.

The stitching machine 14 further includes a bobbin assembly (not shown) that is moved in unison with the stitching head 22; and a thread spool (not shown) for supplying thread 30 to the needle 24. The thread 30 is drawn from the spool and threaded through an eye of the needle 24. Under control of the control station 16, the motor group 28 positions the needle 24 over a stitching point 20 on the preform 18, and the needle 24 is plunged into the preform 18. The bobbin assembly, which is on the underside of the preform 18, grabs the thread 30 and forms a loop. The needle 24 is withdrawn from the preform 18 and, under control of the control station 16, it is repositioned over the next stitching point 20. Once again, the needle 24 is plunged into the preform 18, the bobbin assembly grabs the thread 30, forms another loop, and also locks a stitch. The needle 24 is withdrawn from the preform 18 and moved to the next stitching point 20. The stitching process is repeated.

The stitching machine 14 further includes a load cell 32 placed near the needle 24 along a thread path. The load cell 32 generates a tension feedback signal TN proportional to tension in the thread 30 at or near the needle 24.

The control station 16 includes a processor 36 and computer memory 38. Encoded in the computer memory 38 is CNC code 40 for including instructions for instructing the processor 36 to control the stitching machine 14. Also encoded in the computer memory 38 is a host program 41 for executing the CNC instructions and causing an I/O circuit 43 to send commands to the stitching machine to perform the CNC instructions. The CNC code 40 includes stitching instructions that contain the coordinates of the stitching points. The processor 36 processes the CNC instructions and, through the I/O circuit 43, commands the motor group 28 to move the stitching head 14 to the coordinates and the stitching head 14 to make the stitches at the coordinates. The processor 36 receives position feedback signals from the motor group 28 and closes the control loop on the servo-controlled motors.

The CNC code 40 also includes instructions that instruct the processor 36 to derive stitching data from the feedback signal TN and generate a map 42 of the stitching data. For each stitching point, the I/O circuit 43 continuously samples the feedback signal TN, and the processor 36 filters out noise, and derives a thread tension measurement at a peak time. The processor 36 can also analyze the thread tension measurements and store results of the analysis in the map 42. Thus, the stitching data could include the thread tension measurements and/or an analysis of the thread tension measurement, such as an identification of defective stitches. The stitching data could further include time references of when the stitches were made. Among other things, the time references allow time-based video images of the stitches to be traced to their stitching points. A video camera 44 takes the time-based video images of the stitches. Knowing the reference time of a particular stitch, the video image of that stitch can be found.

The processor 36 stores the stitching data and the x- and y-coordinates of the stitching point at which the stitching data is derived. An entry in the map 42 could be as follows:

| entry | x-coord | y-coord | data |
|---|---|---|---|
| 1 | 125.000 | 115.125 | XXX |

Thus a single map entry could identify a stitching point by its x- and y-coordinates, provide a link to a video image of the stitching point, and provide an analysis of the thread tension measurement at the stitching point. If the stitch is defective, it can then be traced to its x- and y-coordinates. For a preform in which a million stitches are made, the map 42 conveniently organizes a million entries.

Figure 3:
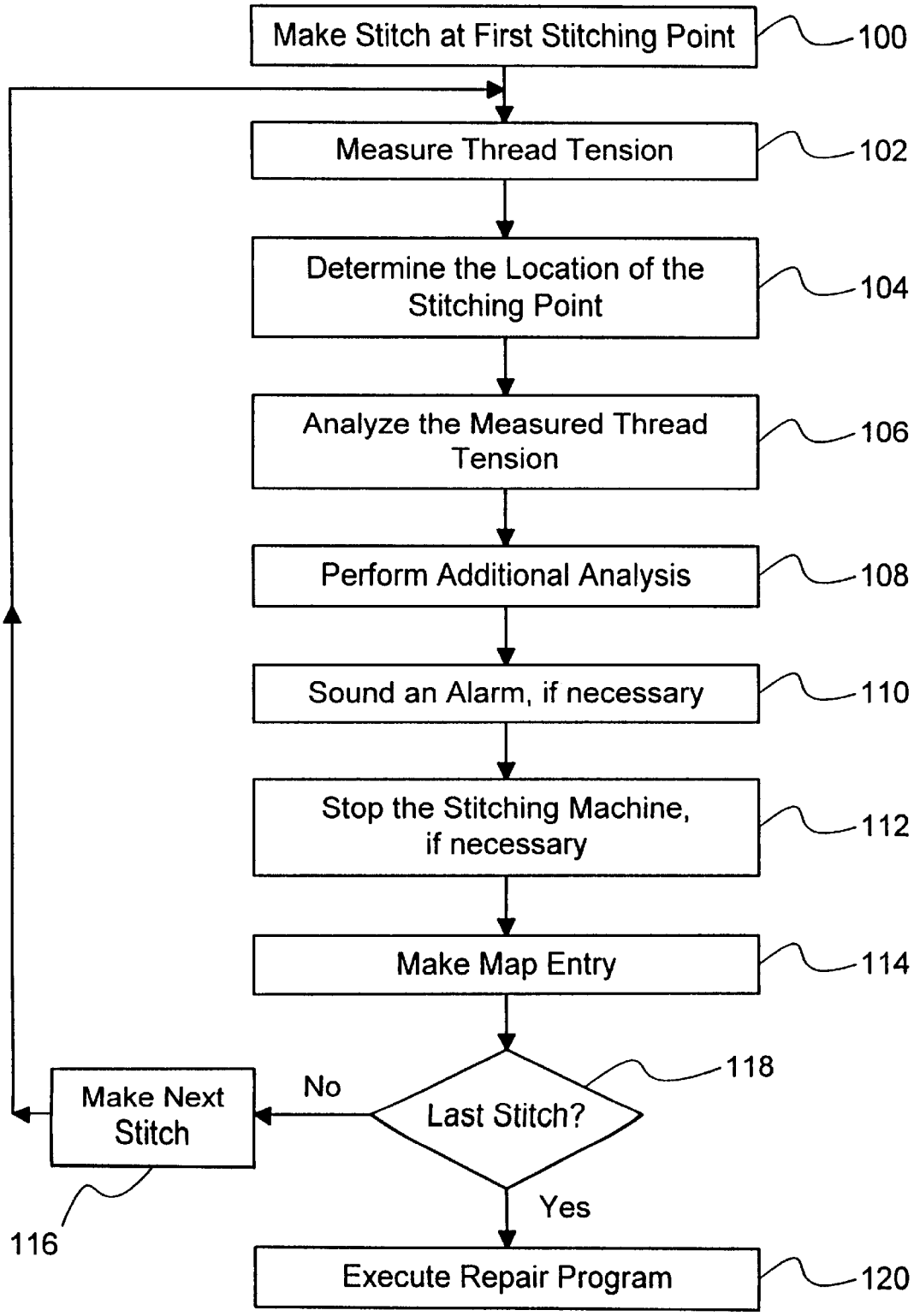
FIG. 3 is a flowchart of a first method of performing quality control for stitching, the method being performed by the system of FIG. 1.
Figure 4:
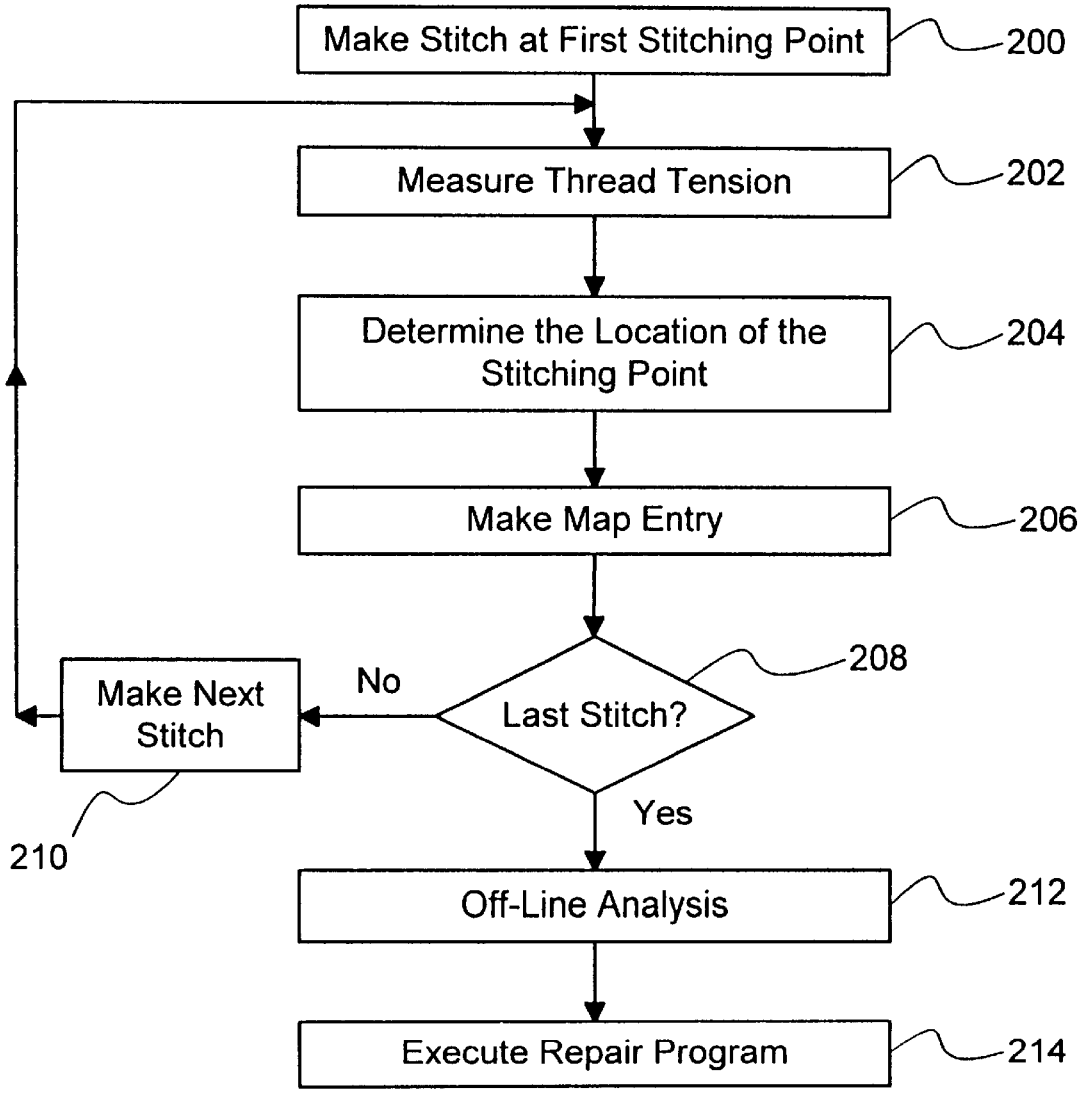
FIG. 4 is a flowchart of a second method of performing quality control for stitching, the method being performed by the system of FIG. 1.

FIGS. 3 and 4 show the steps for performing quality control, including two different ways in which the map 42 is generated and used. Reference is made first to FIG. 3. At step 100, the control station 16 processes a stitching instruction for making a first stitch by commanding the motor group 28 to move the stitching head 22 to the first stitching point and the needle-drive mechanism 26 to reciprocate the needle 24. At step 102, while the first stitch is being made, the processor 36 samples the feedback signal TN and derives the thread tension measurement for the first stitch.

At step 104, the processor 36 determines the location of the first stitching point. The location can be determined by the position coordinates in the stitching instruction.

At step 106, the processor 36 performs a real-time analysis of the thread tension measurement. For example, the processor 36 could analyze the first stitch by comparing the thread tension measurement to a predetermined value stored in the computer memory 38. A predetermined value such as expected thread tension can be determined empirically. If the difference between the thread tension measurement and the predetermined value at the stitching point is not within a tolerance, the stitch is identified as being defective.

At step 108, additional analysis could be performed. For example, the processor 36 could compare the thread tension measurement to a zero value. Zero tension would suggest that the needle or bobbin thread is broken or that the spool is out of thread.

At step 110, the processor 36 sounds an alarm if a problem is identified. For example, an alarm might be sounded if the processor 36 detects a zone of defective stitches. The operator of the system 10 would have the option of letting the stitching continue or shutting down the stitching machine 14 and investigating the cause of the problem.

At step 112, the processor 36 automatically shuts down the stitching machine 14 if a serious problem is identified. For example, the stitching machine 14 might be shut down if a broken thread is detected. Both steps 110 and 112 allow a problem to be corrected in real time.

At step 114, the processor 36 makes a map entry including the x- and y-coordinates of the first stitching point and the stitching data. The stitching data could also include the time reference, which would allow a video image to be traced to the first stitch.

The stitching head 22 is commanded to the next stitching point (step 116), and steps 102 to 114 are repeated. After the last stitch has been made (step 118), the map 42 is accessed and processed, either by the processor 36 or by an external device such as a personal computer. The map 42 allows defective stitches to be identified and repaired. If a zone of defective stitches is identified, the stitches in the zone are removed, and the zone is restitched. In the alternative, new stitches are stitched over the defective stitches.

At step 120, the processor 36 executes a stitching repair program 46 (see FIG. 1) to make new stitches in the zone of defective stitches. The coordinates of the defective stitches are obtained from the map 42.

Reference is now made to FIG. 4, which shows a method in which stitching is performed without interruption and defective stitches are identified off-line. While a stitch is being made at the first stitching point (step 200), thread tension of the first stitching point is measured (step 202), and location of the stitching point is determined (step 204). Then, a map entry is made (step 206). The map entry includes the x- and y-coordinates of the stitching point, along with the thread tension measurement and, perhaps, a reference time. For each additional stitching point (step 208), a new stitch is made (step 210) and steps 200 to 206 are repeated.

After the last stitching point has been stitched (step 208), off-line analysis of the thread tension measurements is performed (step 212). If a zone of stitches is identified, the stitching repair program 46 is executed, and the zone is restitched (step 214).

Thus disclosed is an invention that performs automated quality control for stitching. Zones of defective stitches are identified and corrected quickly. Manual inspection is not needed. Eliminating manual inspection reduces the cost of labor and eliminates the chances of overlooking defective stitches. Eliminating manual inspection also makes quality control less subjective, more accurate and much faster to perform.

The invention is not limited to the preform 18 having the simple two-dimensional surface shown in FIG. 2. It can also be applied to preforms having more complex surfaces, such as compound, contoured three-dimensional surfaces. The invention can also be applied to preforms having variable thickness. Expected thread tension values corresponding to different thicknesses are stored in a lookup table, and thickness of the stitching points are mapped in a ply map. At a given stitching point, the processor 36 accesses the ply map to determine the thickness, finds a matching thickness in the lookup table, and compares the corresponding expected value to the thread tension measurement. If the processor 36 does not find a matching thickness, it takes the expected value of the closest thickness, interpolates, and compares the interpolated value to the thread tension measurement.

The invention can include a stitching machine having multiple stitching heads. Multiple entries—one for each head making a stitch—would be made in the map 42 at any given time.

Thus, the invention is especially useful for the manufacture of preforms for large aircraft structures and other variable-thickness preforms requiring large numbers of high quality stitches on extremely complex stitching surfaces.

Changes and modifications may be made without departing from the spirit and scope of the invention. For example, parameters other than thread tension can be measured and analyzed. Empirical data could be derived by varying a combination of thread tension, thickness and feedrate. Thread tension at a given feedrate would be compared to a predetermined value. The criteria for identifying defective stitches and stitching problems, and the steps taken in response to the stitching problems, are left to the discretion of the system designer and end user.

In general, although a preferred embodiment of the present invention has been described in detail hereinabove, it should be clearly understood that many other variations and/or modifications of the basic inventive concepts herein taught which may appear to those skilled in the pertinent art will still fall within the spirit and scope of the present invention, as defined in the appended claims.

What is claimed is:

1. A method of stitching a textile with automatic stitch quality control, comprising the steps of:

(a) retaining a textile on a textile support structure, wherein the textile support structure comprises a contoured three-dimensional surfaced table;

(b) positioning a stitching head having a source of thread and a sewing needle over a surface of the textile, and wherein, under automatic control, the stitching head is controllably movable to a plurality of different sewing locations across the textile surface and the needle is reciprocally movable relative to the textile;

(c) providing a control station that provides the automatic control, where the control station includes a processor and computer memory;

(d) moving the stitching head to a stitching location based on instructions given by the control station;

(e) making a stitch in the textile at the stitching location;

(f) generating a signal proportional to a thread tension of the stitch while the stitch is being made in step (e);

(g) deriving stitching data including the signal generated in step (f);

(h) generating a map entry by the processor where the map entry includes the stitch location and the corresponding derived stitching data, whereby the derived stitching data is traceable to the corresponding stitch location;

(i) repeating steps (d), (e), (f), (g) and (h) a plurality of times to form a plurality of stitches at different respective locations of the textile and where the plurality of stitches each have respective generated map entries, where said map entries together form a map that is stored in the computer memory;

(j) analyzing the map to identify locations of defective stitches; and (k) repairing defective stitches identified in step (j).

2. The method of claim 1, wherein the deriving of stitching data in step (g) includes performing a real-time analysis of the signal generated in step (f).

3. The method of claim 2, wherein the real-time analysis of the signal is performed by deriving a thread tension measurement from the signal and comparing the thread tension measurement to a predetermined value stored in the computer memory.

4. The method of claim 3, further comprising sounding an alarm where the thread tension measurement differs from the predetermined value by more than a tolerance value stored in the computer memory.

5. The method of claim 3, further comprising automatically stopping stitching of the textile where the thread tension measurement differs from the predetermined value by more than a tolerance value stored in the computer memory.

6. The method of claim 1, wherein the analyzing of the map for locations of defective stitches in step (j) is performed by the control station.

7. The method of claim 6, wherein the analyzing of the map in step (j) is performed by comparing the signal of the thread tension measurement recorded for each map entry to a predetermined value.

8. The method of claim 1, wherein the analyzing of the map in step (j) is performed off-line using a separate processor external to the control station.

9. The method of claim 8, wherein the analyzing of the map in step (j) is performed by comparing the signals of the thread tension measurements to predetermined values.

10. The method of claim 1, further comprising the steps of taking video images of the stitches upon completion of step (e), wherein the map further includes links to the video images.

11. The method of claim 10, wherein the stitching data derived in step (e) further includes time references permitting time-based video images of the stitches to be traced to the corresponding stitching locations.

12. The method of claim 1, wherein, in step (f), said generating of a signal proportional to the thread tension of the stitch while the stitch is being made comprises providing a load cell placed proximate the needle along a thread path, where the load cell generates a tension feedback signal proportional to tension in the thread proximate the needle.

13. The method of claim 1, wherein the stitching location instructions in step (d) are obtained from the computer memory and the stitching location is defined using x and y coordinate values.

14. The method of claim 1, wherein the stitching head is moved to the stitching location in step (d) by a drive motor means under the direction of the control station.

15. The method of claim 1, wherein the needle is reciprocated in step (e) to make the stitch in the textile by a needle-drive mechanism under the direction of the control station.

16. The method of claim 1, wherein said repairing of the defective stitches in step (k) comprises removing the defective stitches and restitching at the locations.

17. The method of claim 1, wherein said repairing of the defective stitches in step (k) comprises stitching new stitches over the defective stitches.

18. A system for automated textile stitching and stitch quality control, comprising:

a textile material support structure comprising a contoured three-dimensional surfaced table;

a stitching machine including a stitching head, where the stitching head has a sewing needle and a source of thread, and wherein the stitching head, under automatic control, is controllably movable to a plurality of different sewing locations across a surface of a textile supported by the support structure and the needle is reciprocally movable relative to the textile;

means for generating a signal proportional to a thread tension of a stitch while a stitch is being made in the textile;

a control station capable of providing the automatic control including a processor and a computer memory, and the memory being encoded with data for instructing the processor:

to determine stitching locations of the stitching head;

derive stitching data from the generated signals; and generate a map of the stitching locations and the corresponding stitching data, whereby the stitching data is traceable to the corresponding stitches;

analyzing means to analyze the map to identify defective stitches; and repairing means to repair the identified defective stitches.

19. The system of claim 18, further comprising a video camera for taking time-based video images of the stitches, wherein the encoded data further instructs the processor to add video image links to the map, the video image links linking the video images to the stitching data.

20. The system of claim 18, wherein the memory is further encoded with data for instructing the processor to direct the repairing means to repair the identified zones of defective stitches.

21. The system of claim 18, wherein said means of generating a signal proportional to the thread tension of the stitch while the stitch is being made comprises a load cell placed proximate the needle along a thread path, where the load cell being capable of generating a tension feedback signal proportional to tension in a thread proximate the needle.

22. The system of claim 18, wherein the encoded data further instructs the processor to derive the stitching data by performing a real-time analysis of the signal.

* * * * *